US010676245B2

(12) United States Patent
Anderson et al.

(10) Patent No.: US 10,676,245 B2
(45) **Date of Patent: *Jun. 9, 2020**

(54) THREADED PLUGS IN FURNITURE BEING PARTIALLY SUBMERGED

(71) Applicant: Ledge Lounger Inc., Brookshire, TX (US)

(72) Inventors: Christopher Anderson, Brookshire, TX (US); Dylan Schrader, Brookshire, TX (US)

(73) Assignee: Ledge Lounger, Inc., Brookshire, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/140,530

(22) Filed: Sep. 24, 2018

(65) Prior Publication Data

US 2020/0095024 A1 Mar. 26, 2020

Related U.S. Application Data

(63) Continuation-in-part of application No. 15/610,338, filed on May 31, 2017, now Pat. No. 10,104,975.

(60) Provisional application No. 62/343,225, filed on May 31, 2016, provisional application No. 62/343,166, filed on May 31, 2016.

(51) Int. Cl.

| | |
|---|---|
| ***B65D 39/08*** | (2006.01) |
| ***A47C 15/00*** | (2006.01) |
| ***B63B 35/74*** | (2006.01) |
| ***A47C 7/00*** | (2006.01) |
| ***A47B 37/04*** | (2006.01) |
| *A47C 1/14* | (2006.01) |

(52) U.S. Cl.

CPC ..... *B65D 39/082* (2013.01); *A47B 37/04* (2013.01); *A47C 7/00* (2013.01); *A47C 15/004* (2013.01); *B63B 35/74* (2013.01); *A47C 1/14* (2013.01)

(58) Field of Classification Search

CPC ..... B63B 35/73; B63B 35/74; A47C 7/00; A47C 7/002; A47C 15/00; A47C 15/004; A47C 15/006; A47C 1/00; A47C 1/143; A47C 1/146; A47C 37/00; A47C 37/04; B65D 39/00; B65D 39/082

USPC ..... 441/129, 130

See application file for complete search history.

(56) References Cited

U.S. PATENT DOCUMENTS

| | | | |
|---|---|---|---|
| 3,316,581 | A | 5/1967 | Hornsby |
| 3,710,019 | A | 1/1973 | Hell |
| 4,384,857 | A | 5/1983 | Hoy, Jr. |

(Continued)

*Primary Examiner* — Lars A Olson

(74) *Attorney, Agent, or Firm* — Banner & Witcoff, Ltd.

(57) ABSTRACT

A submergible furniture is disclosed. Said submergible furniture comprises a threaded plugs, an outer shell and an internal cavity is configured to be partially submerged in a external body of liquid having a external liquid level. Said internal cavity is sealed by said outer shell and said threaded plugs. Said internal cavity comprises a gas portion and a liquid portion. Said liquid portion comprises an internal liquid level. Said submergible furniture is configured to be partially submerged in a external body of liquid. Said internal liquid level is higher than said external liquid level. Said internal cavity is selectively sealed with said threaded plugs. Said threaded plugs comprises a female plug portion and a male plug portion. Said female plug portion is welded into a portion of said outer shell. Said female plug portion is plastic welded into a portion of said outer shell.

20 Claims, 10 Drawing Sheets

(56) References Cited

U.S. PATENT DOCUMENTS

| | | | | |
|---|---|---|---|---|
| 4,986,781 | A * | 1/1991 | Smith | A47C 15/006<br>441/130 |
| 5,415,316 | A | 5/1995 | Pemberton et al. | |
| 6,116,285 | A | 9/2000 | Wilson | |
| 8,506,010 | B2 | 8/2013 | Kane | |
| 9,139,263 | B2 * | 9/2015 | Rubey | B63B 35/74 |
| 9,642,467 | B2 * | 5/2017 | Rubey | B63B 35/74 |
| 10,104,975 | B2 * | 10/2018 | Anderson | B63B 35/74 |

* cited by examiner

THREADED PLUGS IN FURNITURE BEING PARTIALLY SUBMERGED

CROSS-REFERENCE TO RELATED APPLICATIONS

This application claims benefit to U.S. Patent Application Number(s) 62/343,225 filed on May 31, 2016; 62/343,166 filed on May 31, 2016; and is further a continuation in part of Ser. No. 15/610,338 filed on May 31, 2017.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

In the field of partially submerged furniture, there remains a problem with ensuring furniture remains grounded as water levels change. One goal of the current disclosure is to ensure that submergible furniture remain planted as water levels change and as users of said submergible furniture come and go.

Further, as a means of reaching this partial goal of this system, a threaded plugs is introduced with special characteristics designed for holding an liquid portion within said submergible furniture.

Likewise, said threaded plugs are designed to overcome a shortcoming of the prior art; namely, failure to hold a seal against a external body of liquid outside of said submergible furniture when a user sits on said submergible furniture. Think of the pressure spike on said submergible furniture with a quick increase in weight on said submergible furniture, if said threaded plugs are not designed to hold high pressures, then it will burst open and spil said liquid portion.

The current system is applicable to a wide range of partially submerged furniture. Illustrated herein are a table and a chair, but other types are known in the art.

Prior art known to the Applicant includes U.S. Pat. Nos. 3,316,581 A, 4,384,857 A, 5,415,316 A, and 8,506,010 B2.

None of the known inventions and patents, taken either singularly or in combination, is seen to describe the instant disclosure as claimed.

BRIEF SUMMARY OF THE INVENTION

A submergible furniture is disclosed. Said submergible furniture comprises a threaded plugs, an outer shell and an internal cavity is configured to be partially submerged in a external body of liquid having a external liquid level. Said internal cavity is sealed by said outer shell and said threaded plugs. Said internal cavity comprises a gas portion and a liquid portion. Said liquid portion comprises an internal liquid level. Said submergible furniture is configured to be partially submerged in a external body of liquid. Said internal liquid level is higher than said external liquid level. Said internal cavity is selectively sealed with said threaded plugs. Said threaded plugs comprises a female plug portion and a male plug portion. Said female plug portion is welded into a portion of said outer shell. Said female plug portion is plastic welded into a portion of said outer shell. Said female plug portion selectively receives a portion of said male plug portion to create a seal in said outer shell. Said female plug portion comprises a female threading. Said male plug portion comprises a male threading. Said male threading comprises a threading width. Said female threading comprises said threading width so as to selectively seal with said male threading. Said female plug portion comprises a lower portion and an upper portion. Said lower portion comprises a first width. Said upper portion comprises a second width. Said first width of said lower portion is smaller than said second width of said upper portion. Said upper portion and said lower portion are round. Said lower portion comprises a one or more grips. Said male plug portion comprises a slot configured to receive a portion of a rotating driving tool to assist in installing said male plug portion into a portion of said female plug portion. Said threaded plugs comprises a first plug assembly and a second plug assembly. Said threaded plugs are installed in a bottom surface of said submergible furniture. Said submergible furniture comprises a chair. Said submergible furniture comprises a table.

A submergible furniture is disclosed. Said submergible furniture comprises a threaded plugs, an outer shell and an internal cavity is configured to be partially submerged in a external body of liquid having a external liquid level. Said internal cavity is sealed by said outer shell and said threaded plugs. Said internal cavity comprises a gas portion and a liquid portion. Said liquid portion comprises an internal liquid level. Said submergible furniture is configured to be partially submerged in a external body of liquid. Said internal liquid level is higher than said external liquid level. Said internal cavity is selectively sealed with said threaded plugs. Said threaded plugs comprises a female plug portion and a male plug portion. Said female plug portion selectively receives a portion of said male plug portion to create a seal in said outer shell. Said threaded plugs comprises a weld. Said weld secures and seals a portion of said threaded plugs to said outer shell of said submergible furniture.

DETAILED DESCRIPTION OF THE INVENTION

Figure 1:
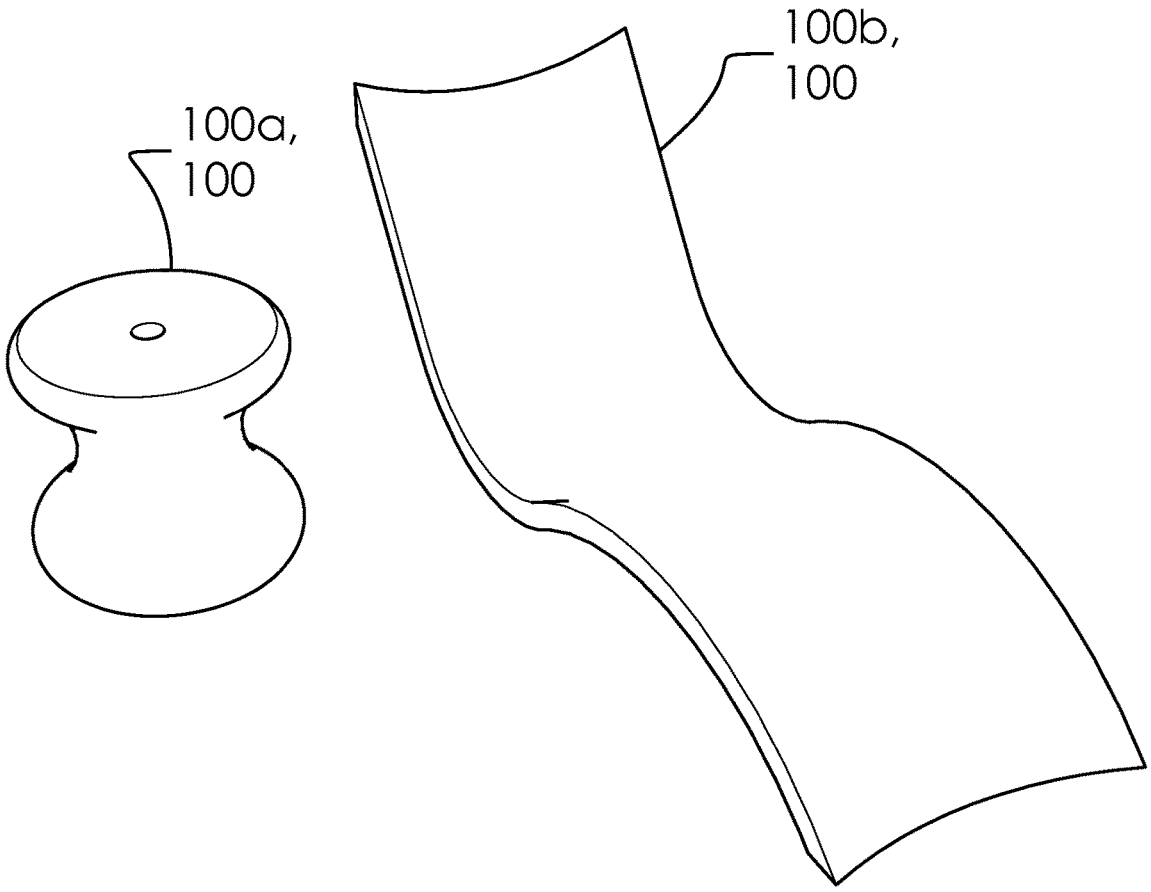
FIG. 1 illustrates a perspective overview view of a submergible furniture 100.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a submergible furniture 100
a table 100*a*
a chair 100*b*
a back 202
a seat 204
a lower bend 206
a foot rest 208
a top surface 210
a bottom surface 212
a first side 214*a*
a second side 214*b*
a top edge 216
a bottom edge 218
a threaded plugs 302
a first plug assembly 302*a*
a second plug assembly 302*b*
a one or more lower portions 402
a first lower portion 402*a*
a second lower portion 402*b*
a female plug portion 502
a male plug portion 504
a lower portion 506
a female threading 510
a male threading 512
a slot 514
a center axis 516
a threading width 518
a closed configuration 700*a*
an open configuration 700*b*
an external body of liquid 800
an internal liquid level 802
an external liquid level 804
a ground surface 806
an outer shell 808
an internal cavity 810
a gas portion 812
a liquid portion 814
a threaded plug 902
a first plug assembly 902*a*
a second plug assembly 902*b*
a top surface 904
a bottom surface 906
an upper portion 908
a middle portion 910
a bottom portion 912
a center aperture 914
an internal water level 1002

FIG. 1 illustrates a perspective overview view of a submergible furniture 100.

In one embodiment, said submergible furniture 100 can comprise said table 100*a* and said chair 100*b*.

In one embodiment, each of said submergible furniture 100 can comprise a rotationally molded piece (such as said table 100*a*) having a threaded plug therein (illustrated and discussed infra).

As illustrated, said submergible furniture 100 (comprising said table 100*a*, said chair 100*b*, and similar furniture) can be designed to be submerged into a body of water (or said external body of liquid 800, discussed and illustrated below).

For example, in one embodiment, said chair 100*b* can be used in the water of a swimming pools, wet environments, outdoor patios, or similar locations.

One shortcoming of the prior art is a tendency of fluids intentionally trapped within said submergible furniture 100 to seep out or spill out as users place weight on said submergible furniture 100.

Figure 2:
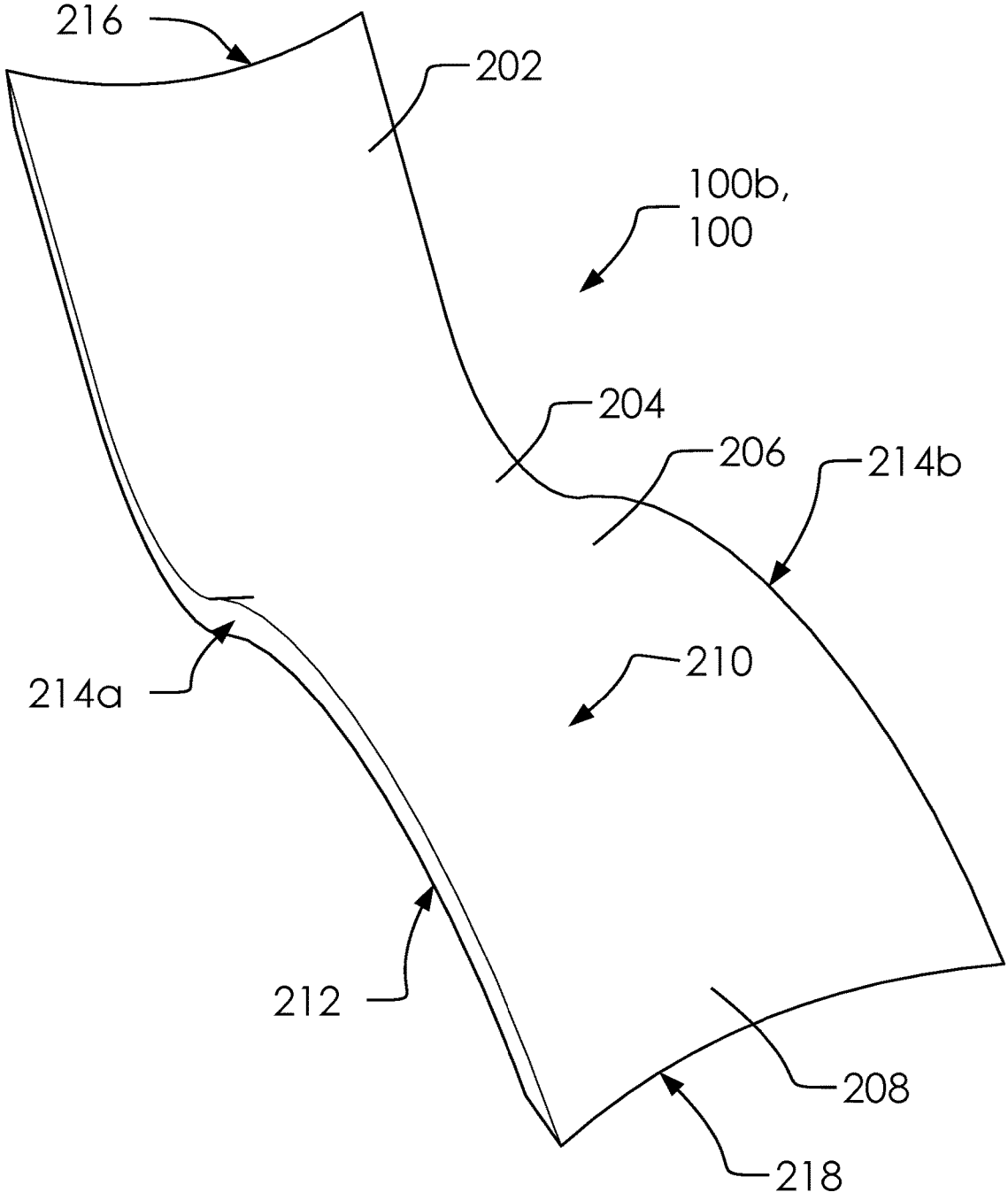
FIG. 2 illustrates a perspective overview view of a chair 100*b*.

FIG. 2 illustrates a perspective overview view of a chair 100*b*.

In one embodiment, said chair 100*b* can comprise said back 202, said seat 204, said lower bend 206, said foot rest 208, said top surface 210, said bottom surface 212, said first side 214*a*, said second side 214*b*, said top edge 216 and said bottom edge 218.

Designs for said chair 100*b* are well-known in the art and may comprise variations on the shape and dimensions of said chair 100*b*. Here, said chair 100*b* has a wave shape having said back 202 with a higher height than said lower bend 206. Likewise, said lower bend 206 has a gentle arc as coming up from said seat 204 and down to said foot rest 208.

Said chair 100*b* can be designed for use in water (that is, liquids comprised substantially of water, as is known in the art). However, try as one might, it is difficult to remove all gases from within a vessel such as said chair 100*b*. Even if all gases are removed, a pressure spike can cause said chair 100*b* to leak out fluids, accordingly a better system for sealing said submergible furniture 100 is necessary. Further, because it is advantageous to add liquids within said submergible furniture 100 to keep them grounded, a strategy for doing so would be advantageous.

Figure 3:
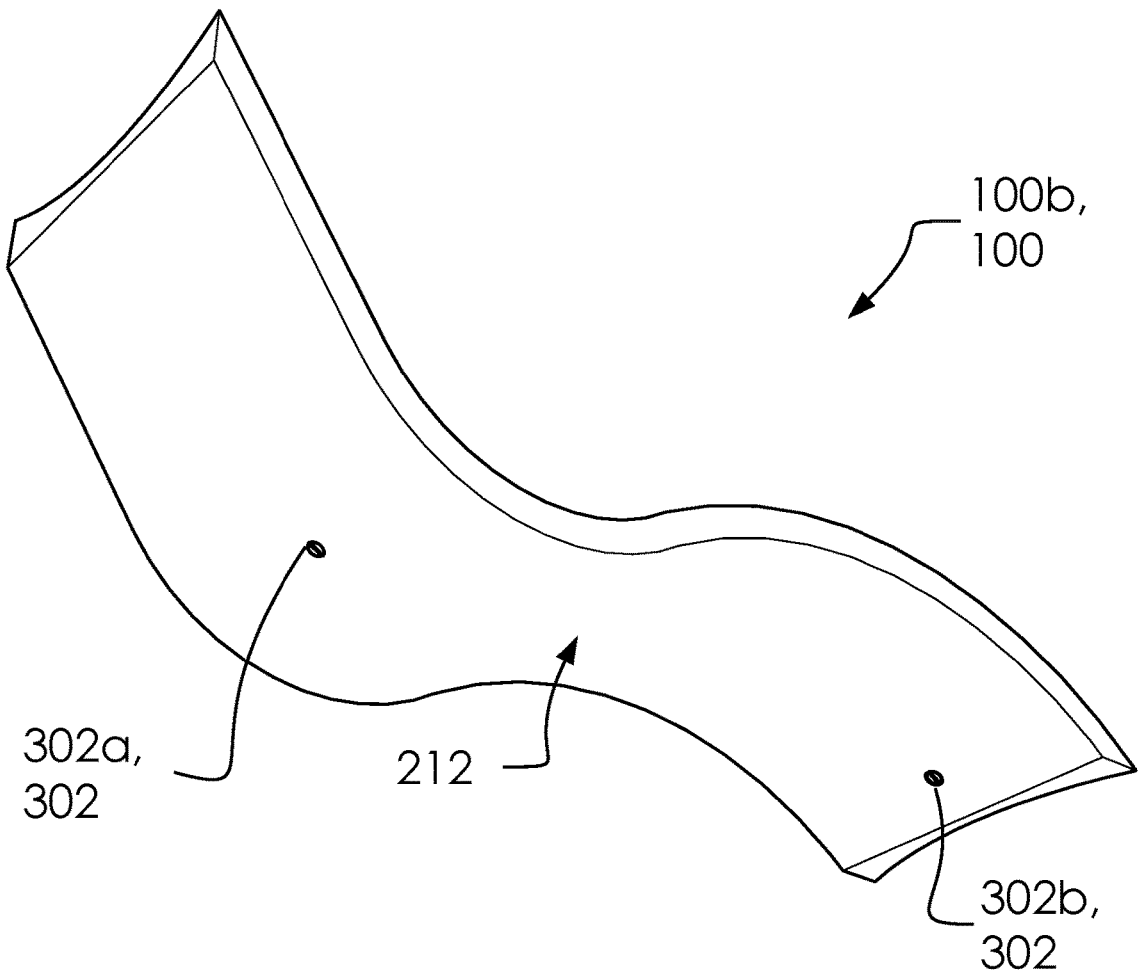
FIG. 3 illustrates a perspective bottom side view of a chair 100*b*.

FIG. 3 illustrates a perspective bottom side view of a chair 100*b*.

In one embodiment, said threaded plugs 302 can comprise said first plug assembly 302*a* and said second plug assembly 302*b*.

In one embodiment, said chair 100*b* can comprise said threaded plugs 302.

In one embodiment, said threaded plugs 302 can comprise threaded plugs for holding a fluid within said submergible furniture 100, as shown and described herein.

Said threaded plugs 302 can be located relatively low on said chair 100*b* but not so low as to cause friction between said threaded plugs 302 and a ground surface below said submergible furniture 100.

Figure 4A:
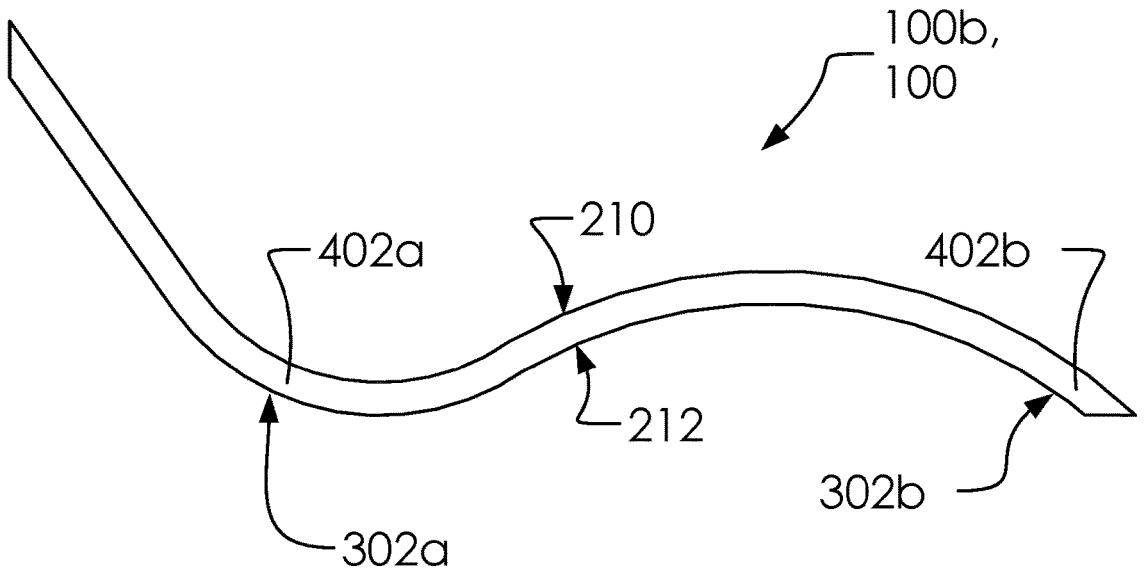
FIG. 4A illustrates an elevated first side view of a chair 100*b*.

FIG. 4A illustrates an elevated first side view of a chair 100*b*.

Figure 4B:
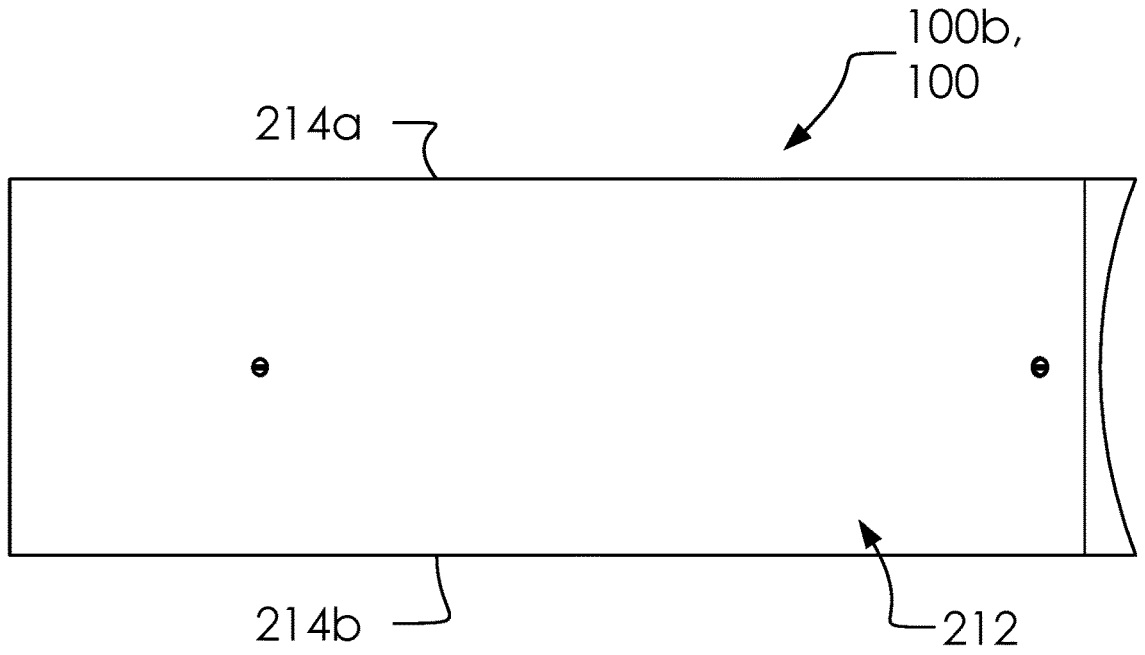
FIG. 4B illustrates an elevated bottom side view of a chair 100*b*.

FIG. 4B illustrates an elevated bottom side view of a chair 100*b*.

In one embodiment, said one or more lower portions 402 can comprise said first lower portion 402*a* and said second lower portion 402*b*.

In one embodiment, said chair 100*b* can comprise said one or more lower portions 402.

Here, said threaded plugs 302 can be associated with various and multiple cavities within one among said submergible furniture 100. For example, said chair 100*b* has a first lower portion 402*a* and a second lower portion 402*b* where water may be captured having different water levels. In one embodiment, said threaded plugs 302 can be located according to different water levels as desired by a designer.

Figure 5A:
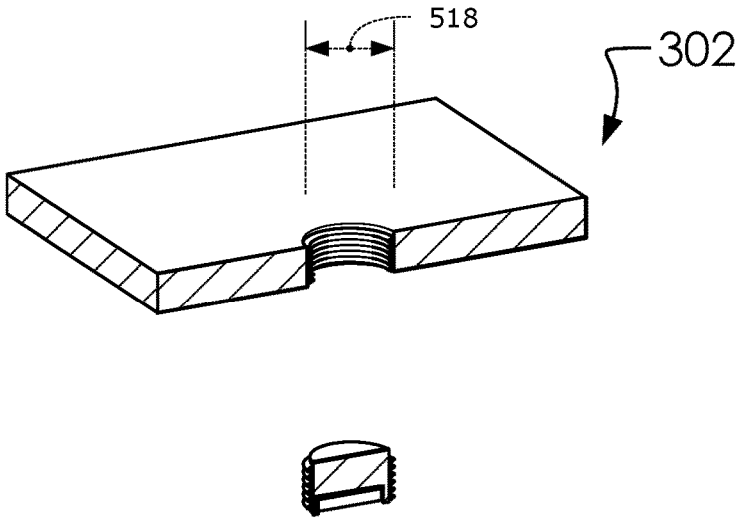
FIG. 5A illustrates a perspective bottom side view of a threaded plugs 302 exploded.

FIG. 5A illustrates a perspective bottom side view of a threaded plugs 302 exploded.

Figure 5B:
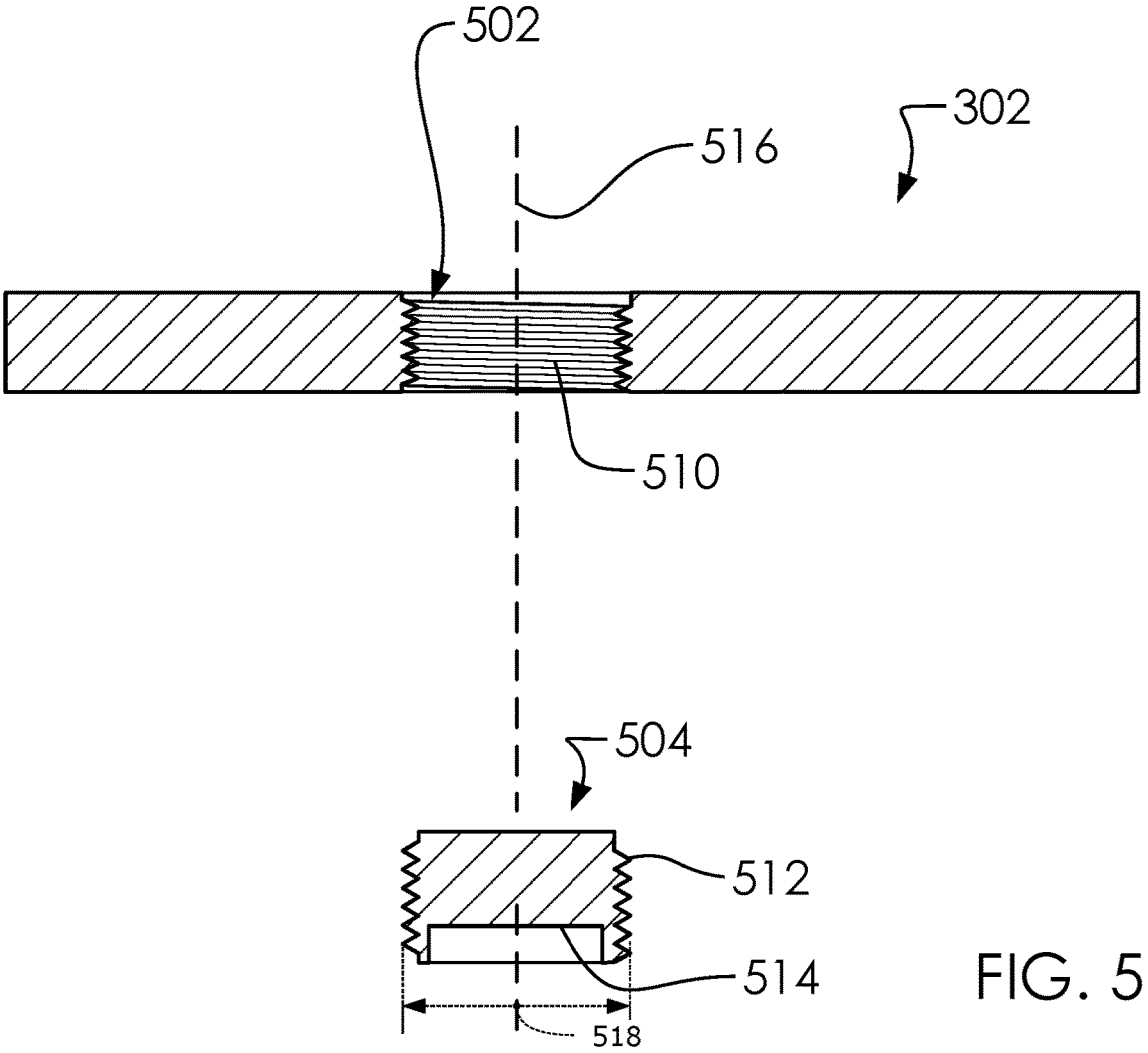
FIG. 5B illustrates a perspective overview view of a threaded plugs 302 exploded.

FIG. 5B illustrates a perspective overview view of a threaded plugs 302 exploded.

In one embodiment, said female plug portion 502 can comprise an aperture in a portion of submergible furniture 100 having said female threading 510.

In one embodiment, said male plug portion 504 can comprise said male threading 512 and said slot 514.

In one embodiment, said female threading 510 and said male threading 512 can comprise said threading width 518.

In one embodiment, said threaded plugs 302 can comprise a portion of said male plug portion 504 screwed into said female plug portion 502 along said center axis 516.

As discussed in U.S. patent application Ser. No. 15/610,338 (parent application to this continuation in part), in one embodiment, welding of plastics can comprise hot gas welding or similar. Quoting https://en.wikipedia.org/wiki/Plastic_welding, "Hot gas welding, also known as hot air welding, is a plastic welding technique using heat. A specially designed heat gun, called a hot air welder, produces a jet of hot air that softens both the parts to be joined and a plastic filler rod, all of which must be of the same or a very similar plastic."

In one embodiment, said threaded plugs 302 can be welded into said outer shell 808 of said submergible furniture 100 about a circumference of said female plug portion 502. Thereafter, said female plug portion 502 can withstand pressure spikes from within said submergible furniture 100.

In one embodiment, said slot 514 can receive a driving tool such as a screw driver. In this case, said slot 514 might receive a head of a straight head screw driver, however, other sockets might be used in the future, as is known in the art.

As illustrated, said male threading 512 could foreseeably twist right through said female threading 510, but it is known in the art that treading can be designed to stop rotation and seal one vessel from another. Such common knowledge is incorporated by reference herein. Herein, a head portion 520 of said male plug portion 504 can seal against said submergible furniture 100

Figure 6A:
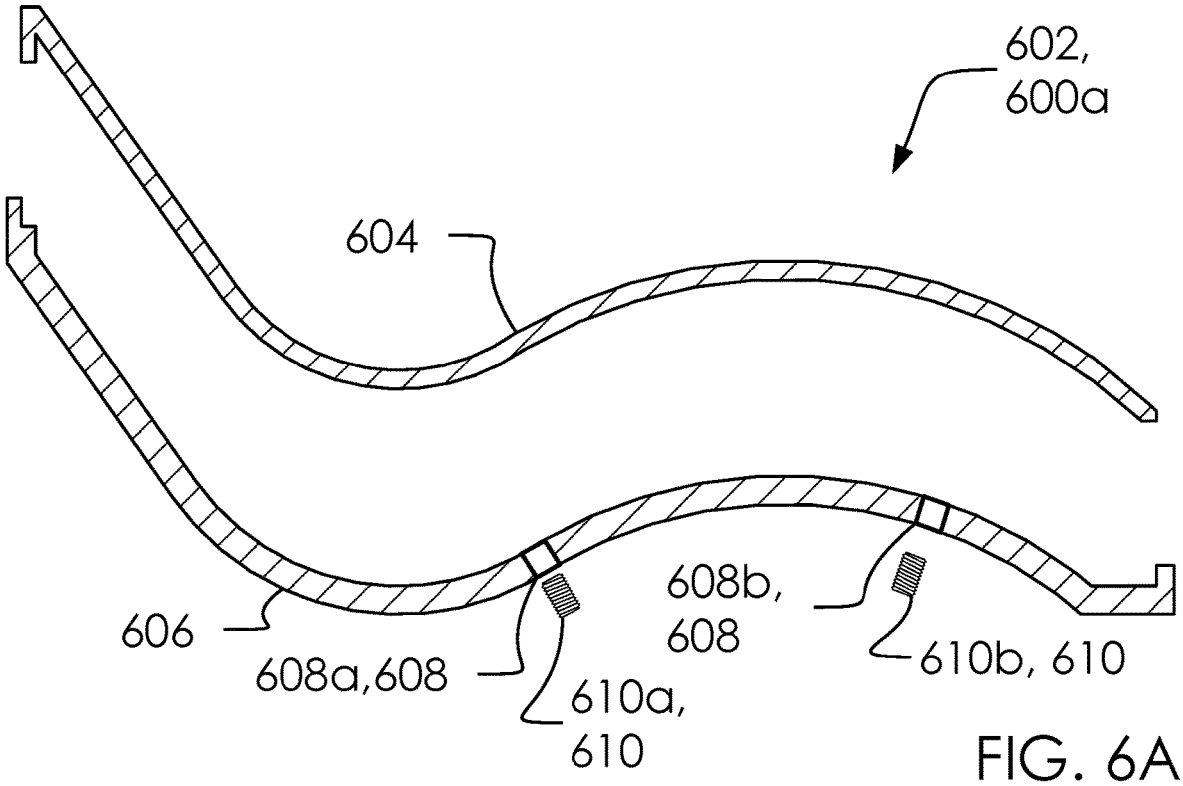
FIG. 6A illustrates an elevated overview view of a threaded plugs 302 exploded in cross-section.
Figure 6B:
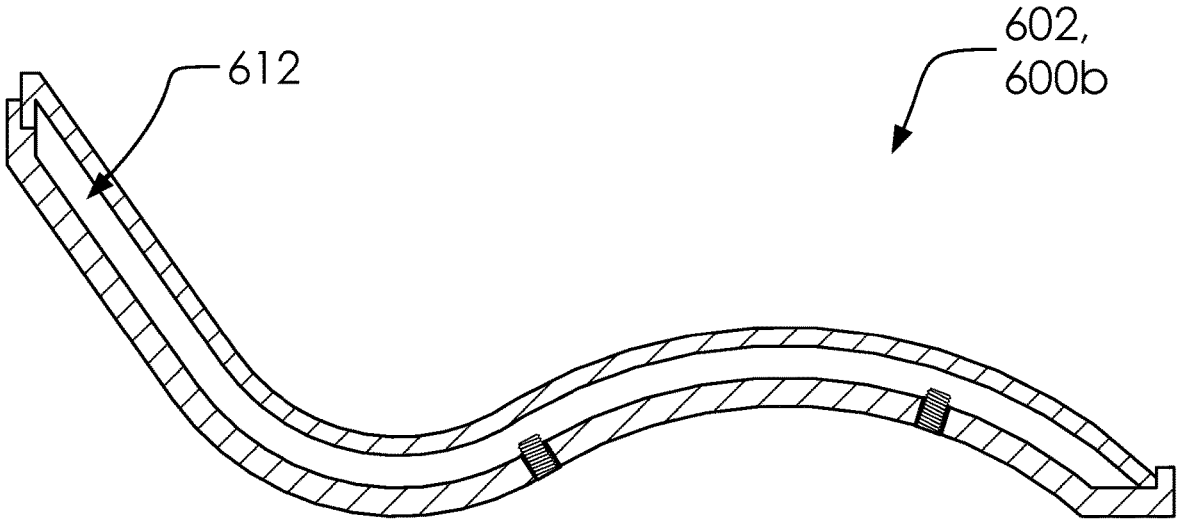
FIG. 6B illustrates an elevated front side view of a threaded plugs 302 in cross-section.

FIGS. 6A and 6B illustrate an elevated side view of a mold 602 in an exploded configuration 600*a* and an attached configuration 600*b*, respectfully.

Said mold 602 can comprise a top portion 604, a bottom portion 606, a one or more apertures 608 (which can comprise a first aperture 608*a* and a second aperture 608*b*), and a one or more molding threaded plugs 610 (which can comprise a first molding threaded plug 610*a* and a second molding threaded plug 610*b*).

Said mold 602 can be used to form said submergible furniture 100 with said female threading 510 integrated at time of molding.

Figure 7A:
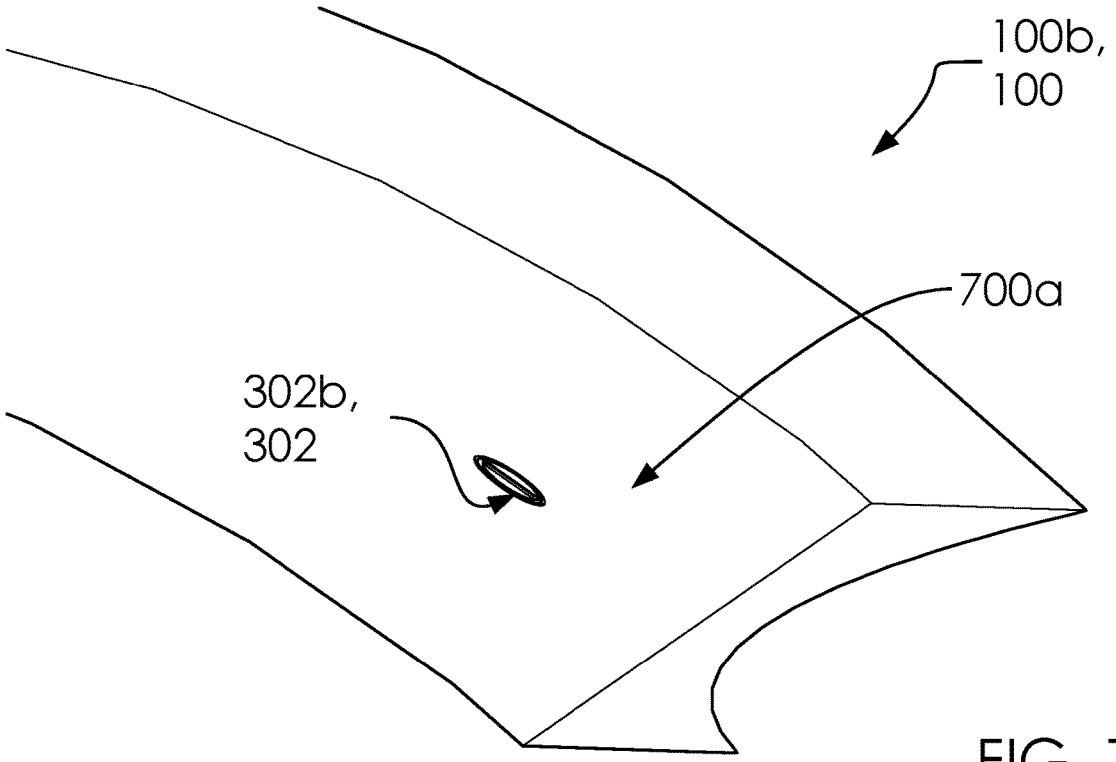
FIG. 7A illustrates a perspective bottom side view of a closed configuration 700*a*.

FIG. 7A illustrates a perspective bottom side view of a closed configuration 700*a*.

Figure 7B:
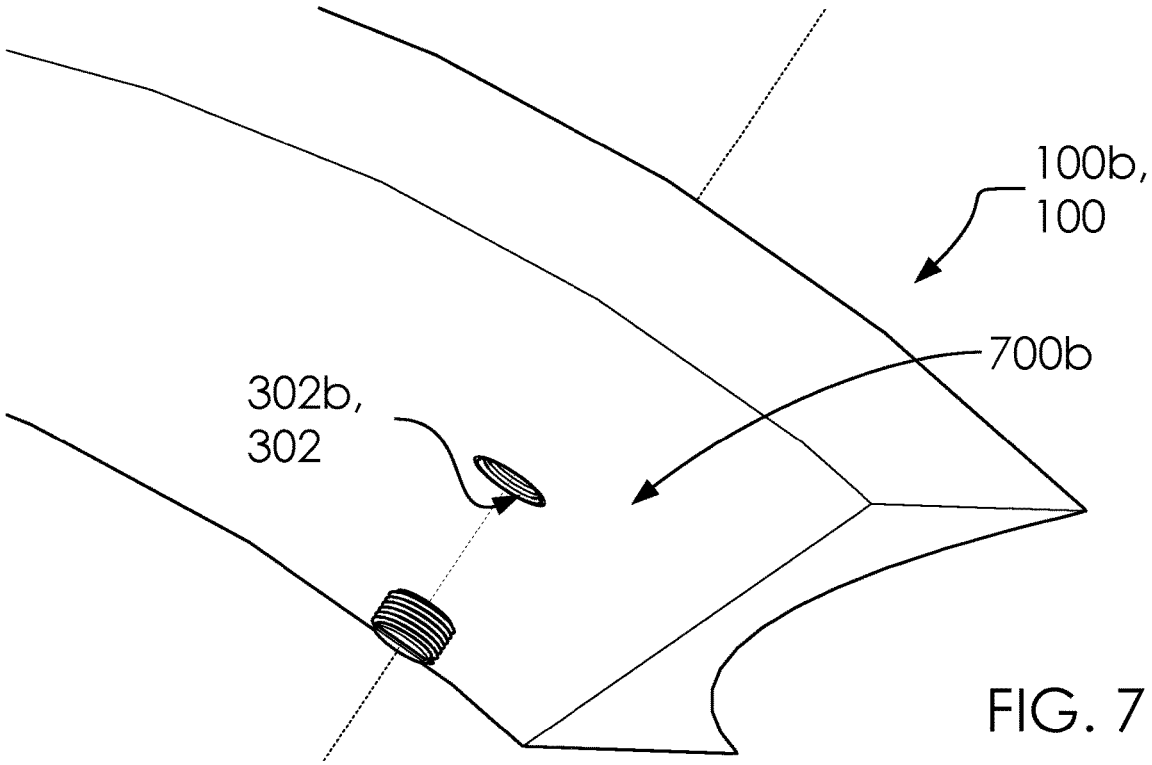
FIG. 7B illustrates a perspective bottom side view of an open configuration 700*b*.

FIG. 7B illustrates a perspective bottom side view of an open configuration 700*b*.

In one embodiment, said threaded plugs 302 can comprise said closed configuration 700*a* and said open configuration 700*b*.

Figure 8:
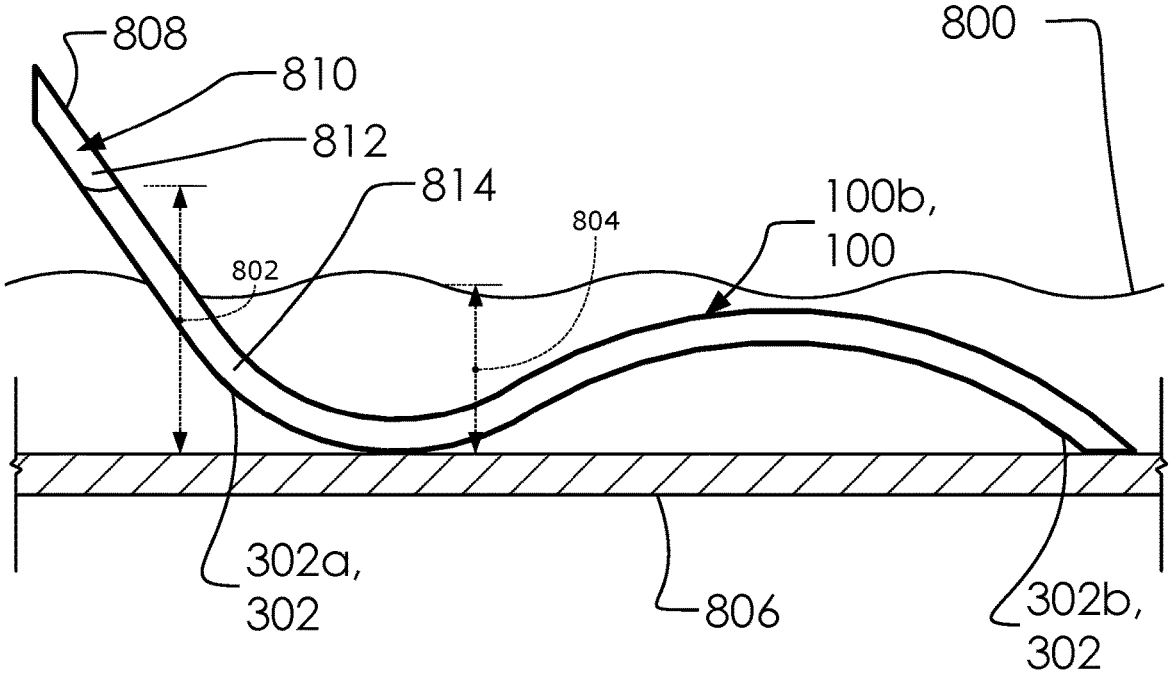
FIG. 8 illustrates an elevated front side view of an external body of liquid 800.

FIG. 8 illustrates an elevated front side view of an external body of liquid 800.

In one embodiment, said external body of liquid 800 can comprise said internal liquid level 802 and said external liquid level 804.

In one embodiment, said internal cavity 810 can comprise said gas portion 812 and said liquid portion 814.

In one embodiment, said submergible furniture 100 can comprise said outer shell 808 and said internal cavity 810.

In one embodiment, said submergible furniture 100 (both of said table 100*a* and said chair 100*b*) can hold a portion of said body of water 800 inside of an outer shell. For example, in one embodiment, said chair 100*b* can comprise an outer shell 808, and a portion of said body of water 800 can be held inside of said outer shell 808 at an internal water level 802. In one embodiment, said body of water 800 can comprise an external water level 804. In one embodiment, said external water level 804 can be lower than said internal water level 802. Accordingly, said submergible furniture 100 are likely to remain partially submerged since a portion of said body of water 800 is held above said external water level 804 and therefore holds said chair 100*b* below said external water level 804. Likewise, ensuring no air is within said outer shell 808 and below said external water level 804 will help said chair 100*b* from floating within said body of water 800 and therefore will by-and-large remain firmly planted on a ground surface 806.

Figure 9A:
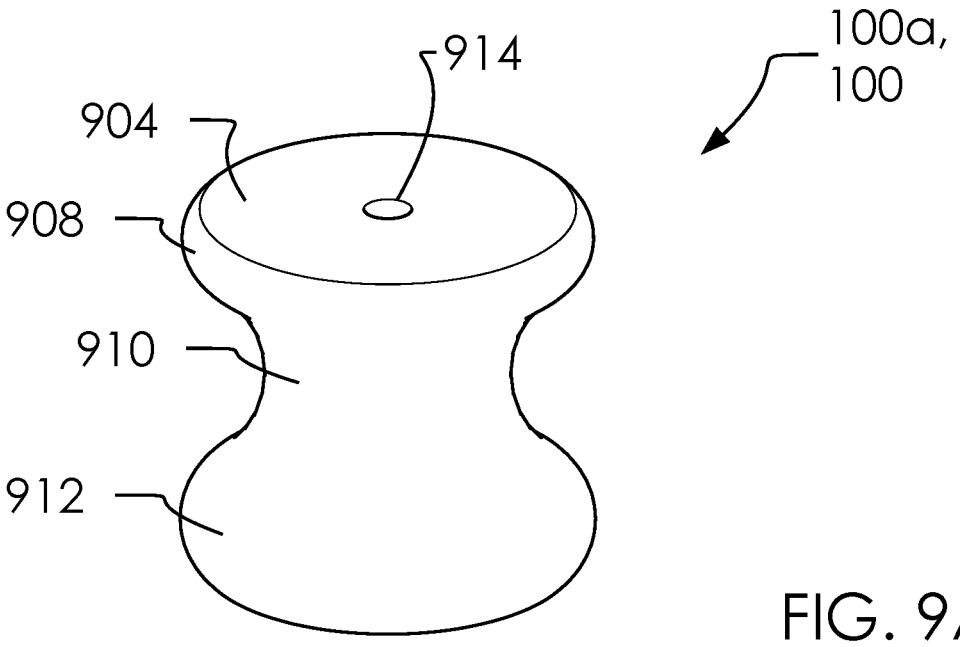
FIG. 9A illustrates a perspective overview view of a table 100*a*.

FIG. 9A illustrates a perspective overview view of a table 100*a*.

Figure 9B:
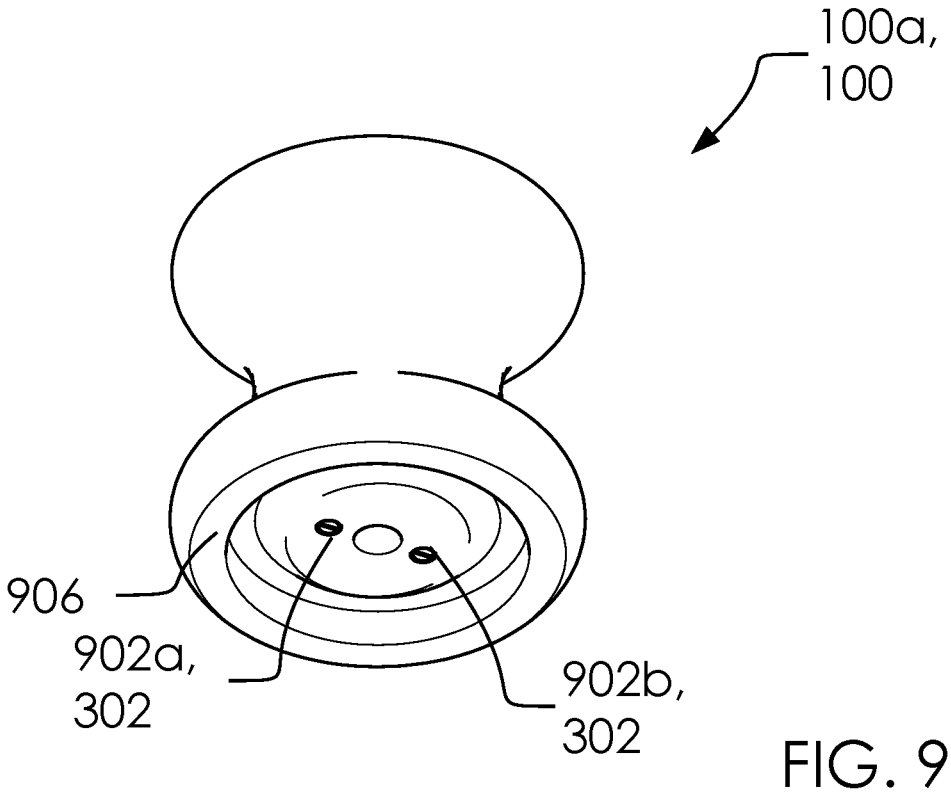
FIG. 9B illustrates a perspective bottom side view of a table 100*a*.

FIG. 9B illustrates a perspective bottom side view of a table 100*a*.

In one embodiment, said threaded plug 902 can comprise said first plug assembly 902*a* and said second plug assembly 902*b*.

In one embodiment, said table 100*a* can comprise said threaded plug 902, said top surface 904, said bottom surface 906, said upper portion 908, said middle portion 910, said bottom portion 912 and said center aperture 914.

In one embodiment, said threaded plugs 302 can comprise said threaded plug 902.

Here again, said threaded plugs 302 (such as said first plug assembly 902*a* and said second plug assembly 902*b*) can be just above said ground surface 806 to prevent friction and wear.

Figure 10:
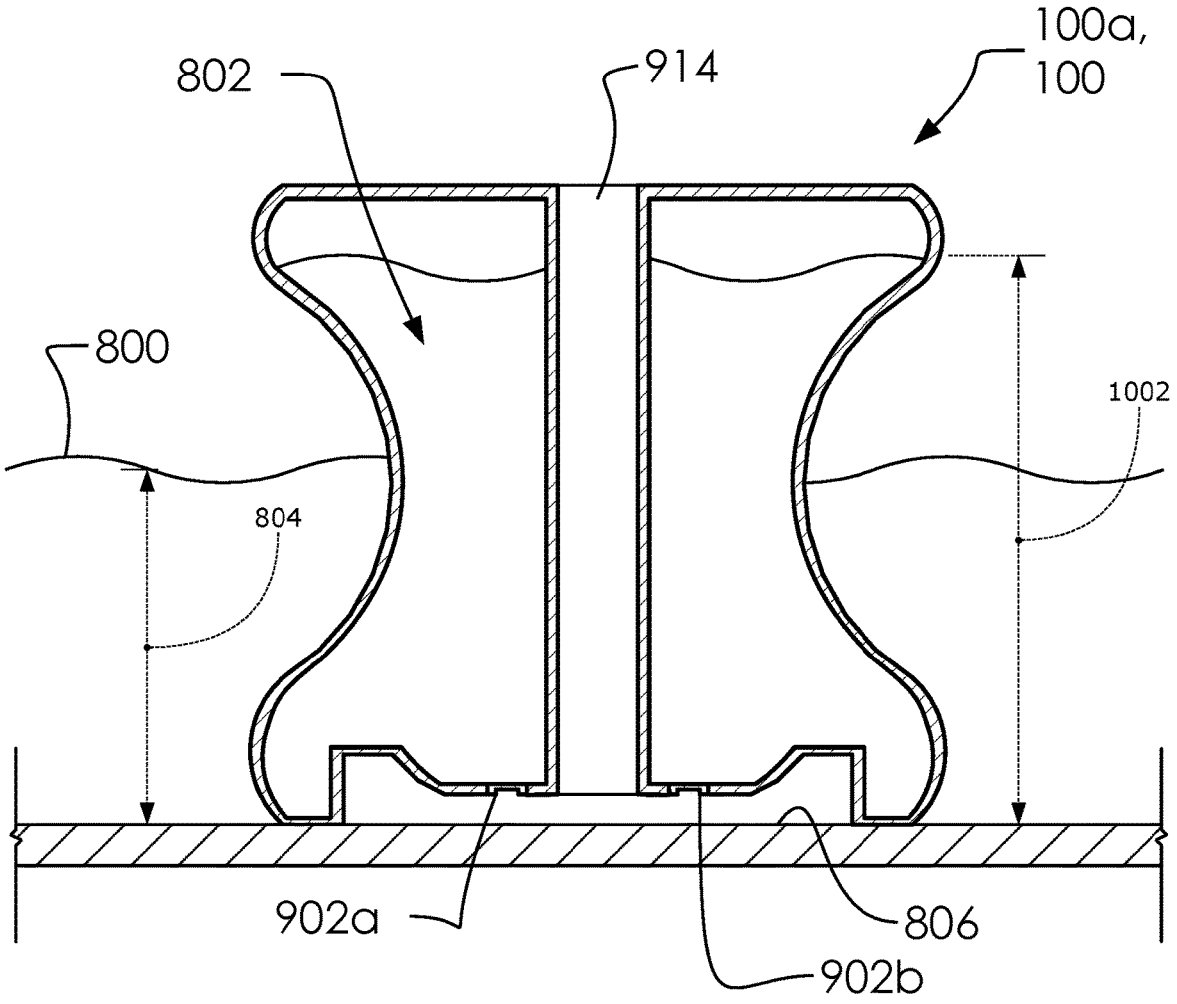
FIG. 10 illustrates an elevated front side view of a table 100*a* in cross-section.

FIG. 10 illustrates an elevated front side view of a table 100*a* in cross-section.

In one embodiment, said chair 100*b* can comprise said internal water level 1002.

In one embodiment, said internal liquid level 802 can comprise said internal water level 1002.

In one embodiment, a portion of said body of water 800 (having an internal water level 1002) can be stored in said table 100*a*, as illustrated. In one embodiment, said internal water level 1002 can be higher than said external water level 804, for reasons discussed above.

In one embodiment, said center aperture 914 can be used to install additional accessories, such as an umbrella, as is known in the art The following sentences are included for completeness of this disclosure with reference to the claims.

A submergible furniture is disclosed. Said submergible furniture comprises a threaded plugs, an outer shell and an internal cavity is configured to be partially submerged in a external body of liquid having a external liquid level. Said internal cavity is sealed by said outer shell and said threaded plugs. Said internal cavity comprises a gas portion and a liquid portion. Said liquid portion comprises an internal liquid level. Said submergible furniture is configured to be partially submerged in a external body of liquid. Said internal liquid level is higher than said external liquid level. Said internal cavity is selectively sealed with said threaded plugs. Said threaded plugs comprises a female plug portion and a male plug portion. Said female plug portion is welded into a portion of said outer shell. Said female plug portion is plastic welded into a portion of said outer shell. Said female plug portion selectively receives a portion of said male plug portion to create a seal in said outer shell. Said female plug portion comprises a female threading. Said male plug portion comprises a male threading. Said male threading comprises a threading width. Said female threading comprises said threading width so as to selectively seal with said male threading. Said female plug portion comprises a lower portion and an upper portion. Said lower portion comprises a first width. Said upper portion comprises a second width. Said first width of said lower portion is smaller than said second width of said upper portion. Said upper portion and said lower portion are round. Said lower portion comprises a one or more grips. Said male plug portion comprises a slot configured to receive a portion of a rotating driving tool to assist in installing said male plug portion into a portion of said female plug portion. Said threaded plugs comprises a first plug assembly and a second plug assembly. Said threaded plugs are installed in a bottom surface of said submergible furniture. Said submergible furniture comprises a chair. Said submergible furniture comprises a table.

A submergible furniture is disclosed. Said submergible furniture comprises a threaded plugs, an outer shell and an internal cavity is configured to be partially submerged in a external body of liquid having a external liquid level. Said internal cavity is sealed by said outer shell and said threaded plugs. Said internal cavity comprises a gas portion and a liquid portion. Said liquid portion comprises an internal liquid level. Said submergible furniture is configured to be partially submerged in a external body of liquid. Said internal liquid level is higher than said external liquid level. Said internal cavity is selectively sealed with said threaded plugs. Said threaded plugs comprises a female plug portion and a male plug portion. Said female plug portion selectively receives a portion of said male plug portion to create a seal in said outer shell. Said threaded plugs comprises a weld. Said weld secures and seals a portion of said threaded plugs to said outer shell of said submergible furniture.

Said submergible furniture comprises a table.

Said submergible furniture comprises a chair.

Said threaded plugs are installed in a bottom surface of said submergible furniture.

Said threaded plugs comprises a first plug assembly and a second plug assembly.

Said male plug portion comprises a slot configured to receive a portion of a rotating driving tool to assist in installing said male plug portion into a portion of said female plug portion.

A lower portion comprises a one or more grips.

An upper portion and said lower portion are round.

Said female plug portion comprises a lower portion and an upper portion. Said lower portion comprises a first width. Said upper portion comprises a second width. Said first width of said lower portion is smaller than said second width of said upper portion.

A male threading comprises a threading width. A female threading comprises said threading width so as to selectively seal with said male threading.

Said female plug portion comprises a female threading. Said male plug portion comprises a male threading. Said female plug portion is securely welded into said outer shell of said submergible furniture with said weld. Said female plug portion comprises a lip.

Said female plug portion is plastic welded into a portion of said outer shell.

Said female plug portion is welded into a portion of said outer shell.

Said lip comprises a narrower circumference than that of said male plug portion, such that said male plug portion presses into said upper portion and seals within said female plug portion.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A submergible furniture, wherein:

said submergible furniture comprises threaded plugs, an outer shell and an internal cavity, and is configured to be partially submerged in an external body of liquid having an external liquid level;

said internal cavity is sealed by said outer shell and said threaded plugs;

said internal cavity comprises a gas portion and a liquid portion;

said liquid portion comprises an internal liquid level;

said submergible furniture is configured to be partially submerged in an external body of liquid;

said internal liquid level is higher than said external liquid level;

said internal cavity is selectively sealed with said threaded plugs;

said threaded plugs comprise a female plug portion and a male plug portion;

said female plug portion is integrated into said submergible furniture;

said female plug portion selectively receives a portion of said male plug portion to create a seal in said outer shell;

said male plug portion comprises a slot configured to receive a portion of a rotating driving tool to assist in installing said male plug portion into a portion of said female plug portion;

a male threading comprises a threading width; and a female threading comprises said threading width so as to selectively seal with said male threading.

2. A submergible furniture, wherein:

said submergible furniture comprises threaded plugs, an outer shell and an internal cavity, and is configured to be partially submerged in an external body of liquid having an external liquid level;

said internal cavity is sealed by said outer shell and said threaded plugs;

said internal cavity comprises a gas portion and a liquid portion;

said liquid portion comprises an internal liquid level;

said submergible furniture is configured to be partially submerged in an external body of liquid;

said internal liquid level is higher than said external liquid level;

said internal cavity is selectively sealed with said threaded plugs;

said threaded plugs comprise a female plug portion and a male plug portion;

said female plug portion is integrated into said submergible furniture; and said female plug portion selectively receives a portion of said male plug portion to create a seal in said outer shell.

3. The submergible furniture of claim 2 wherein:

said submergible furniture comprises a table.

4. The submergible furniture of claim 2 wherein:

said submergible furniture comprises a chair.

5. The submergible furniture of claim 2 wherein:

said threaded plugs are installed in a bottom surface of said submergible furniture.

6. The submergible furniture of claim 2 wherein:

said threaded plugs comprise a first plug assembly and a second plug assembly.

7. The submergible furniture of claim 2 wherein:

said male plug portion comprises a slot configured to receive a portion of a rotating driving tool to assist in installing said male plug portion into a portion of said female plug portion.

8. The submergible furniture of claim 2 wherein:

said female plug portion comprises a lower portion and an upper portion;

said lower portion comprises a first width;

said upper portion comprises a second width; and said first width of said lower portion is smaller than said second width of said upper portion.

9. The submergible furniture of claim 2 wherein:

a male threading comprises a threading width; and a female threading comprises said threading width to selectively seal with said male threading.

10. The submergible furniture of claim 2 wherein:

said female plug portion comprises a female threading;

said male plug portion comprises a male threading;

said female plug portion is securely welded into said outer shell of said submergible furniture with said weld; and said female plug portion comprises a lip.

11. The submergible furniture of claim 2 wherein:

said female plug portion is plastic welded into a portion of said outer shell.

12. The submergible furniture of claim 2 wherein:

said female plug portion is welded into a portion of said outer shell.

13. The submergible furniture of claim 12 wherein:

said lip comprises a narrower circumference than that of said male plug portion, such that said male plug portion presses into said upper portion and seals within said female plug portion.

14. A submergible furniture comprising:

an outer shell having an aperture formed therein and an internal cavity; and a threaded plug seated in the aperture, integrated into the outer shell, and comprising a female plug portion and a male plug portion threadingly received in the female plug portion so as to seal the aperture, wherein the internal cavity is configured to contain a gas and a liquid having an internal liquid level such that when the submergible furniture is partially submerged in a body of liquid having an external liquid level, the internal liquid level is higher than the external liquid level.

15. The submergible furniture of claim 14, further comprising:

an additional aperture formed in the outer shell; and an additional threaded plug seated in the additional aperture, integrated to the outer shell, and comprising a female plug portion and a male plug portion threadingly received in the female plug portion so as to seal the additional aperture.

16. The submergible furniture of claim 15, wherein the additional threaded plug is positioned on a bottom surface of the outer shell.

17. The submergible furniture of claim 16, wherein the female plug portion of each of the threaded plug and the additional threaded plug is welded to the outer shell.

18. The submergible furniture of claim 16, wherein the internal cavity includes a first portion and a second portion separate from the first portion, the threaded plug is associated with the first portion, and the additional threaded plug is associated with the second portion.

19. The submergible furniture of claim 14, wherein the female plug portion comprises a first portion having a first width and a second portion having a second width, the first width being smaller than the second width.

20. The submergible furniture of claim 19, further comprising a plurality of projections positioned around an outer periphery of the first portion.

* * * * *